US008033541B2

(12) United States Patent
Akiyama et al.

(10) Patent No.: US 8,033,541 B2
(45) Date of Patent: Oct. 11, 2011

(54) IMAGE FORMING APPARATUS AND METHOD OF FEEDING A SHEET

(75) Inventors: Shigeki Akiyama, Ichinomiya (JP); Masatoshi Hirano, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/131,905

(22) Filed: Jun. 2, 2008

(65) Prior Publication Data

US 2008/0296836 A1 Dec. 4, 2008

(30) Foreign Application Priority Data

May 31, 2007 (JP) ..... 2007-145522

(51) Int. Cl.
*B65H 5/06* (2006.01)

(52) U.S. Cl. ..... 271/10.03; 271/10.11; 347/104

(58) Field of Classification Search ..... 271/266, 271/270, 272, 10.11, 10.03, 110; 347/104
See application file for complete search history.

(56) References Cited

U.S. PATENT DOCUMENTS

| | | | | |
|---|---|---|---|---|
| 5,056,771 | A * | 10/1991 | Beck et al. | 271/114 |
| 5,223,858 | A * | 6/1993 | Yokoi et al. | 346/134 |
| 6,179,289 | B1 * | 1/2001 | Matsushita et al. | 271/266 |
| 6,791,725 | B1 * | 9/2004 | Ohtani | 358/498 |
| 6,969,141 | B2 | 11/2005 | Horiuchi et al. | |
| 7,178,914 | B2 * | 2/2007 | Marra, III et al. | 347/104 |
| 7,357,387 | B2 * | 4/2008 | Asada | 271/110 |
| 7,396,175 | B2 * | 7/2008 | Ueda | 400/708 |
| 7,497,430 | B2 * | 3/2009 | Kusumi | 271/10.03 |
| 2005/0052484 | A1 | 3/2005 | Horiuchi | |

FOREIGN PATENT DOCUMENTS

| | | | |
|---|---|---|---|
| JP | S59-227639 | A | 12/1984 |
| JP | H04-235848 | A | 8/1992 |
| JP | H08-073062 | A | 3/1996 |
| JP | 2002-283637 | A | 10/2002 |
| JP | 2004-082640 | A | 3/2004 |
| JP | 2005-096450 | A | 4/2005 |

OTHER PUBLICATIONS

Japan Patent Office; Notice of Reasons for Rejection in Japanese Patent Application No. 2007-145522 (counterpart to the above-captioned U.S. patent application) mailed May 19, 2009.

* cited by examiner

*Primary Examiner* — Kaitlin Joerger
(74) *Attorney, Agent, or Firm* — Baker Botts L.L.P.

(57) ABSTRACT

An image forming apparatus includes a tray, a sheet conveying path through which sheets are conveyed, a sheet feeding unit including a sheet feed roller for feeding a first sheet to a sheet holding position, a sheet conveying unit having a conveyor roller that intermittently rotates and holds the sheets. The sheet conveying unit is upstream from a recording position, and downstream from the sheet feeding unit. The image forming apparatus also includes a recording unit, and a controller. The recording unit forms an image onto the first sheet while the conveyor roller is not rotating. The sheet feeding unit feeds a leading edge of a second sheet to the sheet conveying unit and maintains the leading edge of the second sheet colliding against the sheet conveying unit at the sheet holding position by rotating the sheet feed roller prior to completing image formation on the first sheet.

18 Claims, 9 Drawing Sheets

IMAGE FORMING APPARATUS AND METHOD OF FEEDING A SHEET

CROSS REFERENCE TO RELATED APPLICATION

This application claims priority from Japanese Patent Application No. 2007-145522, filed on May 31, 2007, the entire subject matter of which is incorporated herein by reference.

BACKGROUND OF THE INVENTION

1. Field of the Invention

The invention relates to an image forming apparatus configured to pick up recording sheets from a sheet tray and form images onto the respective recording sheets by a recording unit.

2. Description of the Related Art

Known image forming apparatuses pick up recording sheets, e.g., Standard-size sheets, A4-size sheets, and the like from a sheet tray and to form images onto the respective recording sheets. A known image forming apparatus, for example, an inkjet printer, may form images onto a plurality of recording sheets. The image forming apparatus is configured to pick up a recording sheet in a stack of recording sheets from a sheet tray, convey the recording sheet to a predetermined recording position, and form an image onto the recording sheet at the recording position. The image forming apparatus is configured to form images onto respective recording sheets by repeatedly performing a series of the above processes for the printing operation.

A known image forming apparatus may include a sheet conveying mechanism that includes a sheet feed roller and a pair of conveyor rollers. The sheet feed roller may be in contact with a recording sheet accommodated in the sheet tray. The pair of conveyor rollers are disposed downstream from the sheet feed roller and upstream from the recording position in the sheet conveying path. The sheet conveying mechanism further includes a pair of discharge rollers disposed downstream from the recording position in the sheet conveying path. The sheet conveying mechanism is configured to convey a recording sheet by the sheet feed roller, the conveyor rollers, and the discharge rollers.

In the known image forming apparatus, a recording sheet placed on the sheet tray is conveyed toward an upstream part of the sheet conveying path by the rotation of the sheet feed roller. The recording sheet fed from the sheet tray is pinched between the conveyor rollers and is further conveyed to the recording position by the rotation of the conveyor rollers. The recording sheet, on which an image was formed, is then pinched between the discharge rollers and is discharged from the image forming apparatus by the rotation of the discharge rollers.

As a method of performing a continuous printing operation, a known inkjet printer will, at the completion of discharge of the recording sheet after an image forming operation is performed on the recording sheet, a subsequent recording sheet is fed from a sheet tray. Nevertheless, in the known continuous printing operation, the image forming operation may not be performed onto the next recording sheet until the preceding recording sheet is completely discharged after the image forming operation, which may decrease throughput, e.g., the number of sheets that can be printed within a predetermined time period A known image forming apparatus also may not correct skew of recording sheets for second and subsequent pages.

Thus, the recording sheets for the second and subsequent pages may reach the recording position with a skewed orientation. As a result, an image may be formed at an undesirable position on the recording sheet or paper jam may occur in the known image forming apparatus.

SUMMARY OF THE INVENTION

Therefore, a need has arisen for methods and systems for performing a sheet skew correction while increasing throughput in a continuous printing operation.

In an embodiment of the invention, an image forming apparatus comprises a tray configured to accommodate a plurality of sheets, a sheet conveying path through which the plurality of sheets are conveyed, a sheet feeding unit comprising a sheet feed roller configured to feed a first sheet of the plurality of sheets from the tray through the sheet conveying path to a sheet holding position, a sheet conveying unit comprising a conveyor roller configured to rotate intermittently, and to intermittently hold the plurality of sheets at the sheet holding position, wherein the sheet conveying unit is disposed upstream from a recording position, and downstream from the sheet feeding unit in the sheet conveying path, a recording unit configured to form an image onto a surface of the first sheet at the recording position, and a controller configured to control the sheet conveying unit, the sheet discharging unit, the recording unit, and the sheet feeding unit. The recording unit is configured to form an image onto the first sheet while the conveyor roller is not rotating, and wherein the sheet feeding unit is configured to feed a leading edge of a second sheet through the sheet conveying path to the sheet conveying unit and maintain the leading edge of the second sheet colliding against the sheet conveying unit at the sheet holding position by rotating the sheet feed roller prior to a completion of the forming of an image onto a surface of the first sheet.

In another embodiment of the invention, a method of feeding a sheet comprises the steps of feeding a first sheet from a plurality of sheets in a tray to a sheet conveying path comprising a sheet feeding unit, conveying the first sheet to the recording position by a sheet conveying unit, forming an image onto a surface of the first sheet by a recording unit, when the first sheet reaches a recording position, and while the first sheet is not being conveyed, conveying the first sheet to a downstream end of the sheet conveying path, and discharging the first sheet by a sheet discharging unit, feeding a second sheet of the plurality of sheets from the tray to the sheet conveying unit, wherein the second sheet contacts the sheet conveying unit at the sheet holding position, and controlling the sheet conveying unit, the recording unit, and the sheet feeding unit, wherein the recording unit is configured to form an image onto the first sheet while the conveyor roller is not rotating, and wherein the sheet feeding unit is configured to feed a leading edge of a second sheet through the sheet conveying path to the sheet conveying unit and maintain the leading edge of the second sheet colliding against the sheet conveying unit at the sheet holding position by rotating the sheet feed roller prior to a completion of the forming of an image onto a surface of the first sheet.

In still another embodiment of the invention, a method of feeding a sheet comprises the steps of feeding a first sheet from a plurality of sheets in a tray to a sheet conveying path comprising a sheet feeding unit, conveying the first sheet to the recording position by a sheet conveying unit, forming an image onto a surface of the first sheet by a recording unit, when the first sheet reaches a recording position, and while the first sheet is not being conveyed, conveying the first sheet to a downstream end of the sheet conveying path, and discharging the first sheet by a sheet discharging unit, feeding a second sheet of the plurality of sheets from the tray to the sheet conveying unit, wherein the second sheet contacts the sheet conveying unit at the sheet holding position, and correcting a skew of the second sheet by conveying the second sheet into contact with the sheet conveying unit while the second sheet is not being conveyed by the sheet conveying unit. The step of correcting the skew of the second sheet occurs prior to a completion of the step of forming an image onto a surface of the first sheet.

BRIEF DESCRIPTION OF THE DRAWINGS

For a more complete understanding of the present invention, the needs satisfied thereby, and the objects, features, and advantages thereof, reference now is made to the following descriptions taken in connection with the accompanying drawings.

DETAILED DESCRIPTION OF THE EMBODIMENTS

Embodiments of the present invention and their advantages may be understood by referring to FIGS. 1-9, like numerals being used for like corresponding parts in the various drawings.

Figure 1:
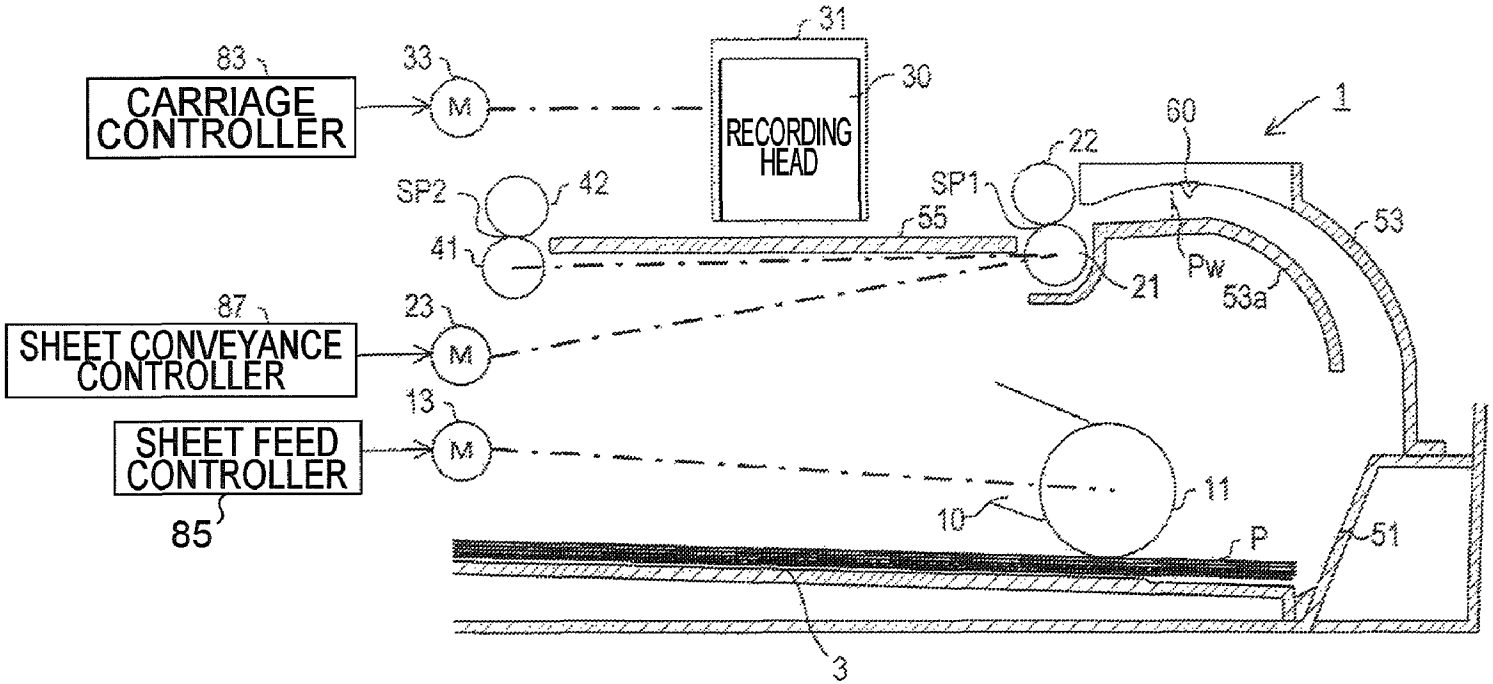
FIG. 1 is sectional view of an inkjet printer according to an embodiment of the invention.

As shown in FIG. 1, an inkjet printer 1 may comprise a sheet tray 3, a sheet feeding unit 10, a conveyor roller 21, a discharge roller 41, an inclined portion 51, a substantially U-shaped wall 53, and a platen 55. Sheet tray 3 may be configured to be loaded with a stack of sheets P. Sheet feeding unit 10 may comprise a sheet feed roller 11, and may be configured to separate the sheets P, one by one, from the stack accommodated in sheet tray 3. Sheet feeding unit 10 also may be configured to feed the separated sheet P into a sheet conveying path by rotation of sheet feed roller 11. Inkjet printer 1 further may comprise pinch rollers 22, 42 which may be disposed such that pinch rollers 22, 42 may face conveyor roller 21 and discharge roller 41, respectively. Conveyor roller 21 and pinch roller 22 may be configured to pinch the sheet P therebetween, and sheet P may be fed by the rotation of sheet feed roller 11.

Conveyor roller 21 further may be configured to convey the pinched sheet P to a recording position, which may be located under a recording head 30, by rotation of conveyor roller 21. Discharge roller 41 and pinch roller 42 may be configured to pinch sheet P, conveyed by the conveyor roller 21, therebetween. Discharge roller 41 further may be configured to discharge sheet P onto a discharge tray (not shown), which may be provided at a downstream end of the sheet conveying path. The sheet conveying path may include inclined portion 51 and U-shaped wall 53.

Sheet feeding unit 10 may be configured to rotate sheet feed roller 11 by a drive force transferred from a sheet feed motor 13 including a direct-current motor. Sheet feeding unit 10 may allow sheet feed roller 11 to contact a top face of a topmost sheet P in the stack placed on sheet tray 3. Sheet feeding unit 10 further may be configured to separate the topmost sheet P from the stack and to feed the separated sheet P into the sheet conveying path by the rotation of sheet feed roller 11.

An upstream part of the sheet conveying path, which may comprise inclined portion 51 and U-shaped wall 53, may be configured to regulate the movement of the sheet P to be fed by sheet feed roller 11 and to guide sheet P to a contact point SP1 between conveyor roller 21 and pinch roller 22, which may be disposed downstream from sheet feed roller 11 in the sheet conveying path. The sheet conveying path further may comprise an auxiliary portion 53*a*, which may be disposed below U-shaped wall 53 and downstream from U-shaped wall 53 in the sheet conveying path. Auxiliary portion 53*a* may be configured to regulate the downward movement of the sheet P in the sheet conveying path and to guide the sheet P to contact point SP1. In inkjet printer 1, the sheet P, which may be fed from sheet tray 3 by sheet feed roller 11, may be guided to contact point SP1 between conveyor roller 21 and pinch roller 22, which may be disposed downstream from U-shaped wall 53 and auxiliary portion 53*a* in the sheet conveying path.

Inkjet printer 1 may comprise a register sensor 60 disposed upstream from contact point SP1 in the sheet conveying path. Register sensor 60 may be configured to detect leading and trailing edges of the sheet P. More specifically, register sensor 60 may comprise a light emitting portion, a light receiving portion, and a light interception mechanism. The light interception mechanism may be configured to rotate to intercept the light traveling from the light emitting portion to the light receiving portion when the sheet P reaches register sensor 60. The light receiving portion of register 60 may be configured not to receive the light from the light emitting portion while the sheet P passes a point where the light interception mechanism is disposed. This may allow register sensor 60 to detect the leading and trailing edges of the sheet P.

When the leading edge of the sheet P reaches contact point SP1, the sheet P may be drawn between conveyor roller 21 and pinch roller 22 by the rotation of conveyor roller 21 and then may be pinched therebetween. Then, conveyor roller 21 may rotate, which may convey sheet P a distance corresponding to the amount of rotation of conveyor roller 21.

Platen 55 may comprise a downstream portion of the sheet conveying path that connects conveyor roller 21 and discharge roller 41. Platen 55 guides the sheet P, which is conveyed by conveyor roller 21, to the recording position at which an image is formed onto the sheet P by recording head 30, and further guides sheet P having the image to a contact point SP2 between discharge roller 41 and pinch roller 42.

The sheet P then may be conveyed toward discharge roller 41 along platen 50. When the leading edge of the sheet P reaches contact point SP2, the sheet P is drawn between discharge roller 41 and pinch roller 42 by the rotation of discharge roller 41 and is pinched therebetween. Then, the sheet P is discharged onto the discharge tray by the rotation of discharge roller 41. Discharge roller 41 and conveyor roller 21 may have substantially the same diameter and may be driven by the same drive source. Conveyor roller 21 and discharge roller 41 may be connected to each other, e.g., by a belt, such that conveyor roller 21 and discharge roller 21 may rotate in synchronization with each other. Conveyor roller 21 may rotate by a drive force transferred from an LF motor 23, which may comprise a direct-current motor.

Recording head 30 may comprise a plurality of nozzles (not shown) that eject ink droplets therefrom. The nozzles may be arranged in a plurality of rows in a bottom face of recording head 30 facing platen 55. Recording head 30 may be mounted on a carriage 31 that may be configured to be movable along a guide shaft (not shown) in a main scanning direction, e.g., a direction perpendicular to the drawing sheet of FIG. 1. Carriage 31 may travel in the main scanning direction by a drive force transferred from a carriage ("CR") motor 33, which may comprise a direct-current motor.

Figure 2:
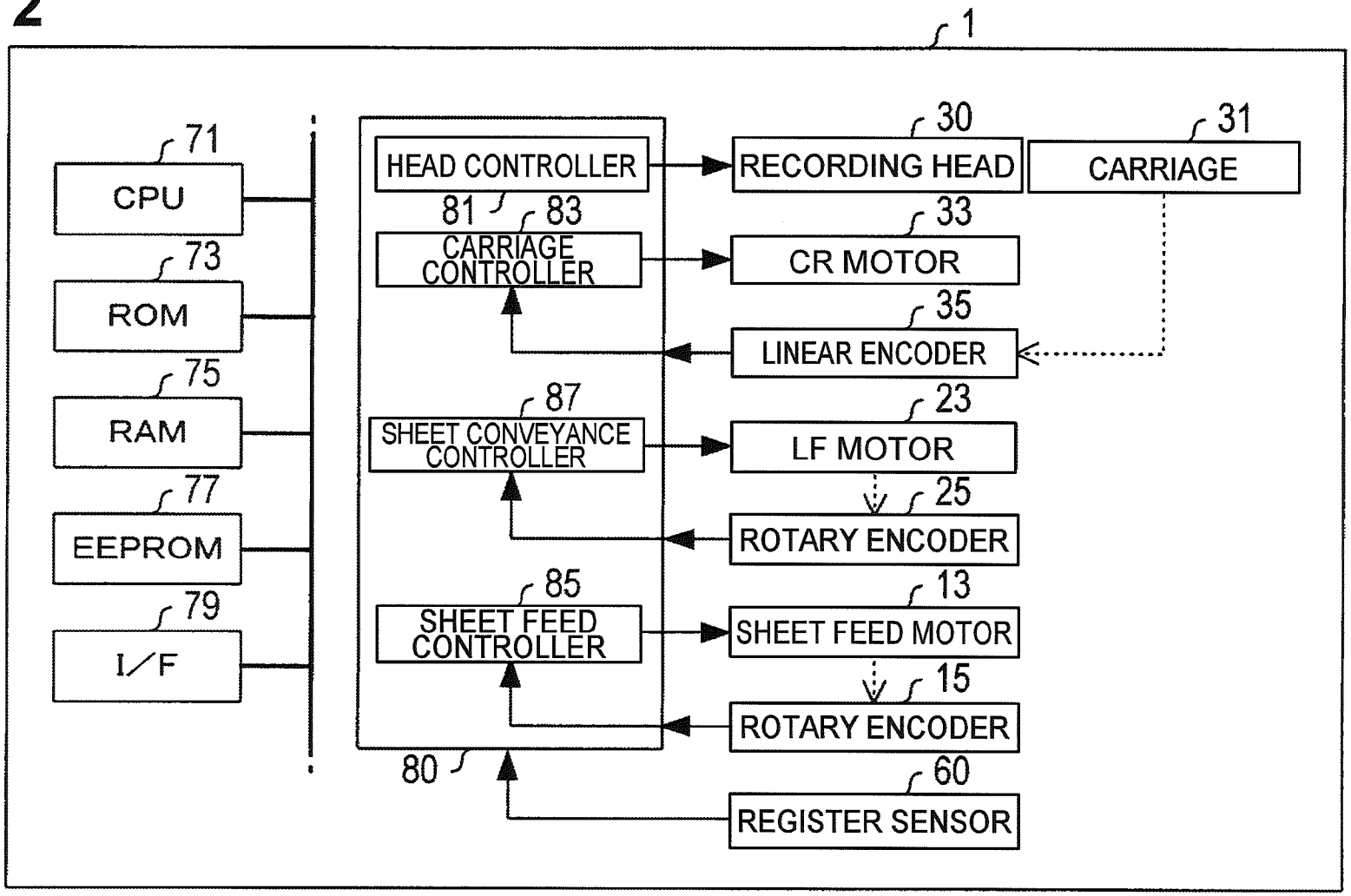
FIG. 2 is a block diagram showing an electrical configuration of an inkjet printer according to an embodiment of the invention.

As shown in FIG. 2, inkjet printer 1 may comprise a CPU 71, a ROM 73 which may be configured to store programs to be performed by the CPU 71, a RAM 75 to be used as a workspace during execution of a program, an EEPROM 77 configured to store various setting information, an interface ("I/F") 79 which may comprise a USB interface, and a head/motor controller 80. Interface 79 may be connected to a personal computer (not shown) and may be configured to receive a print command to be transmitted from the personal computer. Print data may be transmitted together with the print command.

Inkjet printer 1 further may comprise recording head 30, carriage 31, CR motor 33, and a linear encoder 35. CR motor 33 may allow carriage 31 to travel in the main scanning direction. Linear encoder 35 may be disposed along the guide shaft and may be configured to generate a pulse signal in accordance with a current position of carriage 31. Head/motor controller 80 may comprise a carriage controller 83 and a head controller 81. Carriage controller 83 may be configured to control CR motor 33 to move carriage 31 in the main scanning direction. Head controller 81 may be configured to control recording head 30 to eject ink droplets from recording head 30. The traveling of carriage 31 and the ink ejection from recording head 30 may be performed substantially simultaneously. By doing so, an image may be formed on a sheet P in the main scanning direction.

Linear encoder 35 may be connected to head/motor controller 80. An output signal from linear encoder 35 may be inputted into head/motor controller 80 and may be used for the control of CR motor 33 performed by carriage controller 83. Inkjet printer 1 further may comprise sheet feed motor 13 and a rotary encoder 15. Rotary encoder 15 may be configured to output a pulse signal every time sheet feed motor 13 rotates by a predetermined amount. Rotary encoder 15 may be connected to the head/motor controller 80. An output signal from rotary encoder 15 may be inputted into the head/motor controller 80.

Head/motor controller 80 further may include a sheet feed controller 85. Inkjet printer 1 may be configured to detect the rotating amount of sheet feed roller 11, as well as an amount that sheet P is conveyed, based on a signal outputted from rotary encoder 15. Sheet feed controller 85 may be configured to control sheet feed motor 13 to convey the sheet P from sheet tray 3 to conveyor roller 21, based on the detection results.

Inkjet printer 1 further may comprise LF motor 23 and a rotary encoder 25. Rotary encoder 25 may be configured to output a pulse signal every time LF motor 23 rotates by a predetermined amount. Similar to rotary encoder 15, rotary encoder 25 may be connected to head/motor controller 80. An output signal from rotary encoder 25 may be inputted into head/motor controller 80. Head/motor controller 80 further may comprise a sheet conveyance controller 87. Inkjet printer 1 may be configured to detect the rotating amount of conveyor roller 21, the rotating amount of discharge roller 41, and an amount of conveyance of the sheet P, based on a signal outputted from rotary encoder 25. Sheet conveyance controller 87 may be configured to control LF motor 23 to convey the sheet P from conveyor roller 21 to the discharge tray, based on the detection results.

Head/motor controller 80 also may be connected to register sensor 60, and may be configured to detect a position of a sheet P in the sheet conveying path based on signals outputted from register sensor 60 and rotary encoders 15, 25. The position information about the sheet P detected by head/motor controller 80 may be provided to CPU 71. Head/motor controller 80 further may be configured to control recording head 30, CR motor 33, sheet feed motor 13, and LF motor 23, in response to commands issued from CPU 71.

Figure 3:
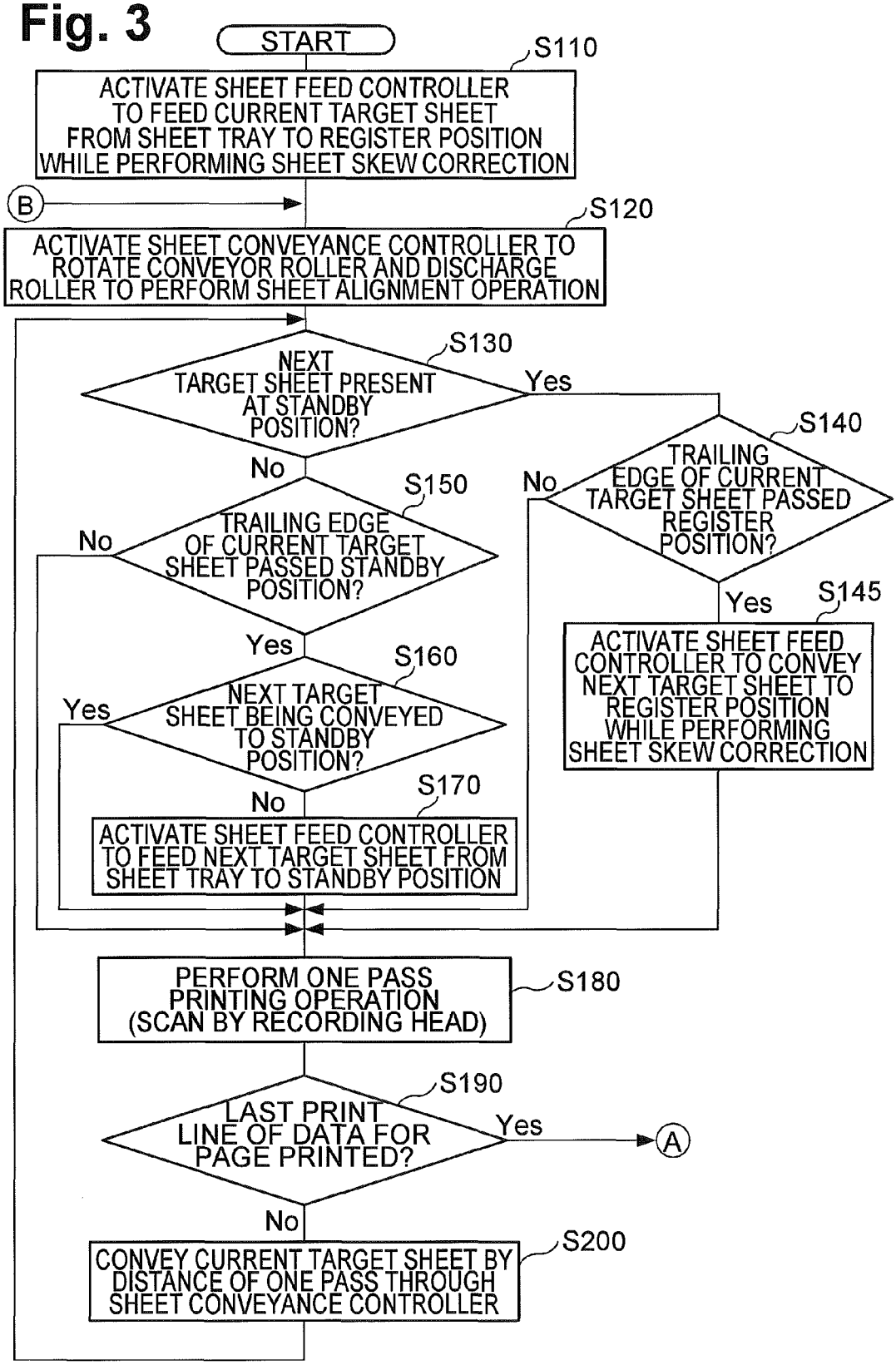
FIG. 3 is a flowchart of print control processing performed by a CPU according to an embodiment of the invention.
Figure 4:
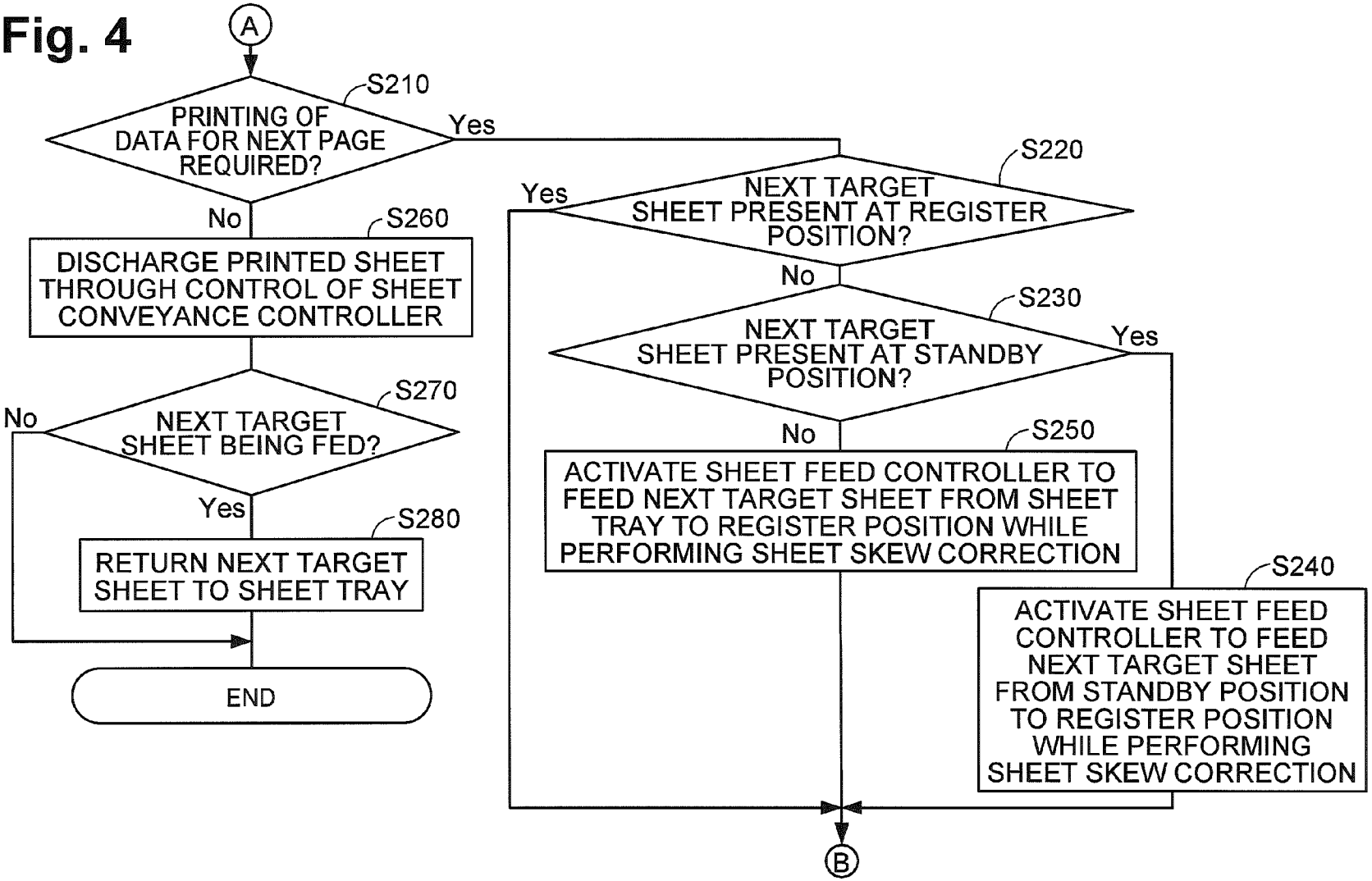
FIG. 4 is a continuation of the flowchart of FIG. 3.

As shown in FIGS. 3 and 4, inkjet printer 1 may be configured to control recording head 30, CR motor 33, sheet feed motor 13, and LF motor 23, in order to form, e.g., print, an image onto a sheet P. The image formed on sheet P by inkjet printer 1 may be based on print data which may be inputted from the personal computer to CPU 71, which may perform print control processing through head/motor controller 80. For example, when print data includes a plurality of pages of data to be printed, inkjet printer 1 successively may print an image for each page on each sheet P.

As shown in FIGS. 3 and 4, when the print control processing starts, CPU 71 may input a command into head/motor controller 80 to activate the sheet feed controller 85. Sheet feed controller 85 may drive sheet feed motor 13 such that a sheet P e.g., a first page (hereinafter interchangeably referred to as a "current target sheet P"), may be fed from sheet tray 3 and may be conveyed to a register position, e.g., contact point SP1 between conveyor roller 21 and pinch roller 22 at Step 110 (hereinafter, steps will be interchangeably referred to using "S" followed by the step number, e.g., S110 corresponds to "Step 110"). At that time, CPU 71 may prevent sheet conveyance controller 87 from rotating conveyor roller 21, while CPU 71 controls sheet feed controller 85, such that current target sheet P may be conveyed in a downstream direction in the sheet conveying path, current target sheet P may adhere to U-shaped wall 53, after a leading edge of current target sheet P reaches contact point SP1.

At this point, current target sheet P may abut, e.g., contact, against contact point SP1. By this sheet abutment operation, the skew of the current target sheet P may be corrected. After the sheet skew correction is completed, flow may continue to S120. At S120, a sheet alignment operation may be carried out. To carry out the sheet alignment operation, CPU 71 may send a command to head/motor controller 80 to activate sheet conveyance controller 87. Sheet conveyance controller 87 may cause LF motor 23 to drive and to rotate conveyor roller 21 and discharge roller 41, such that conveyor roller 21 further may convey current target sheet P from the contact point SP1 until a print start position on the current target sheet P reaches the recording position.

After the sheet alignment operation is completed, flow may continue to S130. At S130, CPU 71 may determine whether a next sheet P to be printed, e.g. a sheet P for a second page, hereinafter, interchangeably referred to as a subsequent target sheet P, is present at a standby position Pw. This determination may be based on the position information about the current target sheet P obtained from head/motor controller 80. A subsequent target sheet P, e.g., a second sheet, may refer to a sheet that follows the current target sheet P, which may have been fed to the position downstream from contact point SP1 in the sheet conveying path. Standby position Pw may be defined at a position that is spaced a predetermined distance downstream from the position at which an edge of a sheet P may be detected by register sensor 60. Subsequent target sheet P temporarily may remain at standby position Pw.

When CPU 71 determines that subsequent target sheet P is present at standby position Pw, e.g., S130:YES, flow may continue to S140. When CPU 71 determines that subsequent target sheet P is not present at standby position Pw, e.g., S130:NO, flow may continue to S150. At S150, CPU 71 may determine whether a trailing edge of current target sheet P has passed standby position Pw, based on position information about the current target sheet P, which may be obtained from head/motor controller 80.

When CPU 71 may determine that the trailing edge of the current target sheet P has passed the standby position Pw, e.g., S150:YES, flow may continue to S160. When CPU 71 may determine that the trailing edge of current target sheet P has not passed the standby position Pw, e.g., S150:NO, flow may continue to S180.

At S160, CPU 71 may determine whether sheet feed controller 85 is conveying subsequent target sheet P to the standby position Pw. When CPU 71 may determine that subsequent target sheet P is not being conveyed to standby position Pw, e.g., the subsequent target sheet P has not been fed from sheet tray 3 yet, e.g., S160:NO, CPU 71 may send a command to head/motor controller 80, which may activate sheet feed controller 85. Sheet feed controller 85 then may drive the sheet feed motor 13, such that subsequent target sheet P may be fed from sheet tray 3 to standby position Pw, e.g., at S170. Then, flow may continue to S180 without waiting for the arrival of subsequent target sheet P at standby position Pw. The time at which flow continues to S180 may be substantially the same as the time at which conveyance of subsequent target sheet P from the sheet tray 3 begins. As described above, with respect to inkjet printer 1, conveyance of subsequent target sheet P from sheet tray 3 may start when the trailing edge of current target sheet P passes standby position Pw.

When CPU 71 may determine that sheet feed controller 85 has been activated and subsequent target sheet P is being conveyed to standby position Pw by sheet feed controller 85, e.g., S160:YES, flow may continue to S180. At S180, CPU 71 may perform a printing operation, e.g., forming an image based on print data. The print operation may be carried out at an area located at the recording position of current target sheet P. That is, CPU 71 may input a command into head/motor controller 80 to activate carriage controller 83 to drive CR motor 33 such that carriage 31 may move in the main scanning direction. At the same time, CPU 71 may control head controller 81 to drive recording head 30 such that recording head 30 may eject ink droplets therefrom, based on the image to be formed. By doing so, CPU 71 may perform the printing operation such that the image based on the print data may be formed in the area located at the recording position of the current target sheet P.

Recording head 30 may have a plurality of nozzles arranged in rows in a sub scanning direction, e.g., the sheet conveying direction. Sub scanning direction may be perpendicular to the main scanning direction. Recording head 30 may be configured to form an image having a plurality of dots in the sub scanning direction. Thus, recording head 30 may allow the formation of an image having a predetermined width in the sub scanning direction on a sheet P in one pass. One pass of the recording head 30 hereinafter will be interchangeably referred to as "the predetermined width."

When the one pass printing operation, e.g., S180 is completed, flow may continue to S190. At S190, CPU 71 may determine whether a last print line of the data for the page has been printed on current target sheet P. As shown in FIG. 4, when CPU 71 may determine that the last print line of the data for the page has been printed, e.g., S190:YES, flow may continue to S210. When CPU 71 may determine that the last print line of the data for the page has not been printed yet, e.g., S190:NO, flow may continue to S200.

At S200, CPU 71 may send a command to head/motor controller 80 to activate the sheet conveyance controller 87. Sheet conveyance controller 87 may drive LF motor 23 such that current target sheet P held by conveyor roller 21 and/or discharge roller 41 further may be conveyed by a predetermined amount in the downstream direction in the sheet conveying path. The conveyance of current target sheet P may be carried out by rotation of conveyor roller 21 and/or discharge roller 41. More specifically, current target sheet P may be conveyed in the downstream direction in the sheet conveying path, by a distance that is equal to one pass of recording head 30.

After the predetermined amount of the sheet conveyance, e.g., S200, is completed, flow may continue to S130 again. At S130, CPU 71 may determine whether subsequent target sheet P is present at standby position Pw. When CPU 71 may determine that subsequent target sheet P is present at standby position Pw, e.g., S130:YES, flow may continue to S140. At S140, CPU 71 may determine whether the trailing edge of current target sheet P has passed the register position.

When CPU 71 may determine that the trailing edge of the current target sheet P has not passed the register position, e.g., S140:NO, flow may continue to S180. At S180, a one pass printing operation may be performed. When CPU 71 may determine that the trailing edge of current target sheet P has passed the register position, e.g., S140:YES, flow may continue to S145. At S145, CPU 71 may send a command to the head/motor controller 80 to activate the sheet feed controller 85. Sheet feed controller 85 may convey subsequent target sheet P, which may be at standby position Pw, to the register position. At that time, similar to the processing of S110, CPU 71 may prevent sheet conveyance controller 87 from rotating conveyor roller 21, while subsequent target sheet P may be fed to conveyor roller 21 such that the skew of subsequent target sheet P may be corrected, by which subsequent target sheet P abuts against, e.g., contacts, contact point SP1.

When CPU 71 may send such a command to head/motor controller 80 to activate the sheet conveyance controller 85, flow may continue to S180, without waiting the arrival of subsequent target sheet P at the register position. In parallel with the sheet conveying operation performed by sheet feed controller 85, one pass printing operation may be performed on current target sheet P, e.g., S180. After completion of the one pass printing operation, flow may continue to S190.

Standby position Pw may be defined at a position where the skew of a waiting sheet P may be corrected. The skew of waiting sheet P may be corrected when sheet P may be conveyed to the register position to abut against, e.g., contact, conveyer roller 21, during the interval between when inkjet printer 1 begins and ends the one pass printing operation at S180. Inkjet printer 1 determines a distance between the register position and the standby position Pw, such that the time required for the sheet conveying operation performed by sheet feed controller 85 may be shorter than a turnaround time of the one pass printing operation.

As described above, subsequent target sheet P may abut against, e.g., contact, conveyor roller 21 while the conveyor roller 21 is not rotating. By doing so, subsequent target sheet P may be fed to conveyor roller 21, while the skew of subsequent target sheet P may be corrected before the last print line of the data for the page may be printed on current target sheet P.

At S190, CPU 71 may determine whether the last print line of the data for the page has been printed on current target sheet P. As shown in FIG. 4, when CPU 71 may determine that the last print line of the data for the page has been printed, e.g., S190:YES, flow may continue to S210. At S210, CPU 71 may determine whether to perform a printing of data for a subsequent page e.g., whether there is any data which has not been printed present in the print data. When CPU 71 determines that the printing of the data for the subsequent page may be performed, e.g., S210:YES, flow may continue to S220. When the CPU 71 determines that the printing of the data for the next page does not need to be performed, e.g., S210:NO, flow may continue to S260.

At S220, CPU 71 may determine whether subsequent target sheet P for the next page has been conveyed to the register position. When CPU 71 determines that the subsequent target sheet P already has been conveyed to the register position, e.g., S220:YES, flow may continue to S120, to perform the sheet alignment operation with respect to subsequent target sheet P. Then, CPU 71 may perform the processing of S130 and subsequent steps. If subsequent target sheet P already has been conveyed downstream from conveyor roller 21 in the sheet conveying path, CPU 71 also may make an affirmative determination at S220, and then may continue to S120.

When CPU 71 may determine that subsequent target sheet P has not been conveyed to the register position, e.g., S220: NO, flow may continue to S230. At S230, CPU 71 may determine whether subsequent target sheet P has been conveyed to the standby position Pw. When the CPU 71 determines that the subsequent target sheet P has been conveyed to the standby position Pw, e.g., S230:YES, CPU 71 may input a command into head/motor controller 80 to activate sheet feed controller 85 to drive sheet feed motor 13, such that subsequent target sheet P at standby position Pw may be conveyed to the register position, e.g., S240.

At S240, similar to the processing of S110, subsequent target sheet P may be fed to conveyor roller 21 while the skew of subsequent target sheet P may be corrected. After the sheet skew correction is completed by the conveyance of the subsequent target sheet P to the register position, flow may continue to S120. If subsequent target sheet P has not reached standby position Pw yet, but instead is being conveyed to standby position Pw, CPU 71 may make an affirmative determination at S230 and then flow may continue to S240. In this case, subsequent target sheet P may be conveyed to the register position at S240, once subsequent target sheet P reaches standby position Pw.

When CPU 71 determines that subsequent target sheet P has not been conveyed to standby position Pw, e.g., S230:NO, CPU 71 may send a command to head/motor controller 80 to activate sheet feed controller 85. Sheet feed controller 85 may drive sheet feed motor 13, such that subsequent target sheet P may be conveyed from sheet tray 3 to the register position, and then the skew of subsequent target sheet P may be corrected, e.g., S250. After sheet skew correction is completed by the conveyance of the subsequent target sheet P to the register position, flow may continue to S120.

When CPU 71 determines that the printing of the data for the next page may not need to be performed (S210:NO), flow may continue to S260. At S260, CPU 71 may input a command into the head/motor controller 80 to activate the sheet conveyance controller 87. Sheet conveyance controller 87 may drive the LF motor 23 such that the printed sheet P, e.g., current target sheet P, held by discharge roller 41, may be discharged onto the discharge tray.

When the discharge of printed sheet P is completed, e.g., S260, CPU 71 may determine whether subsequent target sheet P, e.g., sheet P for the second page, is being fed from sheet tray 3, e.g., S270. If CPU 71 determines that subsequent target sheet P has not yet been fed from sheet tray 3 yet, e.g., S270:NO, CPU 71 may end print control processing. If CPU 71 determines that subsequent target sheet P is being fed from the sheet tray 3, e.g., S270:YES, flow may continue to S280.

At S280, CPU 71 may input a command into head/motor controller 80 to activate the sheet feed controller 85. Sheet feed controller 85 may rotate sheet feed motor 13, e.g., sheet feed roller 11, in the reverse direction, such that subsequent target sheet P may be conveyed backward, e.g., in a reverse direction, to be accommodated in sheet tray 3 again. Inkjet printer 1 may be configured such that the trailing edge of subsequent target sheet P may not yet have passed sheet feed roller 11 when the trailing edge of printed sheet P, e.g., current target sheet P passes discharge roller 41.

As described above, subsequent target sheet P, which now may become unnecessary to be fed, may be returned to sheet tray 3 by performing the processing described in S280, which may prevent deformation of subsequent target sheet P due to subsequent target sheet P remaining at the U-shaped portion of the sheet conveying path defined by the U-shaped wall 53. After S280, CPU 71 may end print control processing, and may wait until new print data is inputted from the personal computer. Upon receipt of new print data from the personal computer, CPU 71 may again start print control processing from the processing of S110 of FIG. 3.

Figure 5:
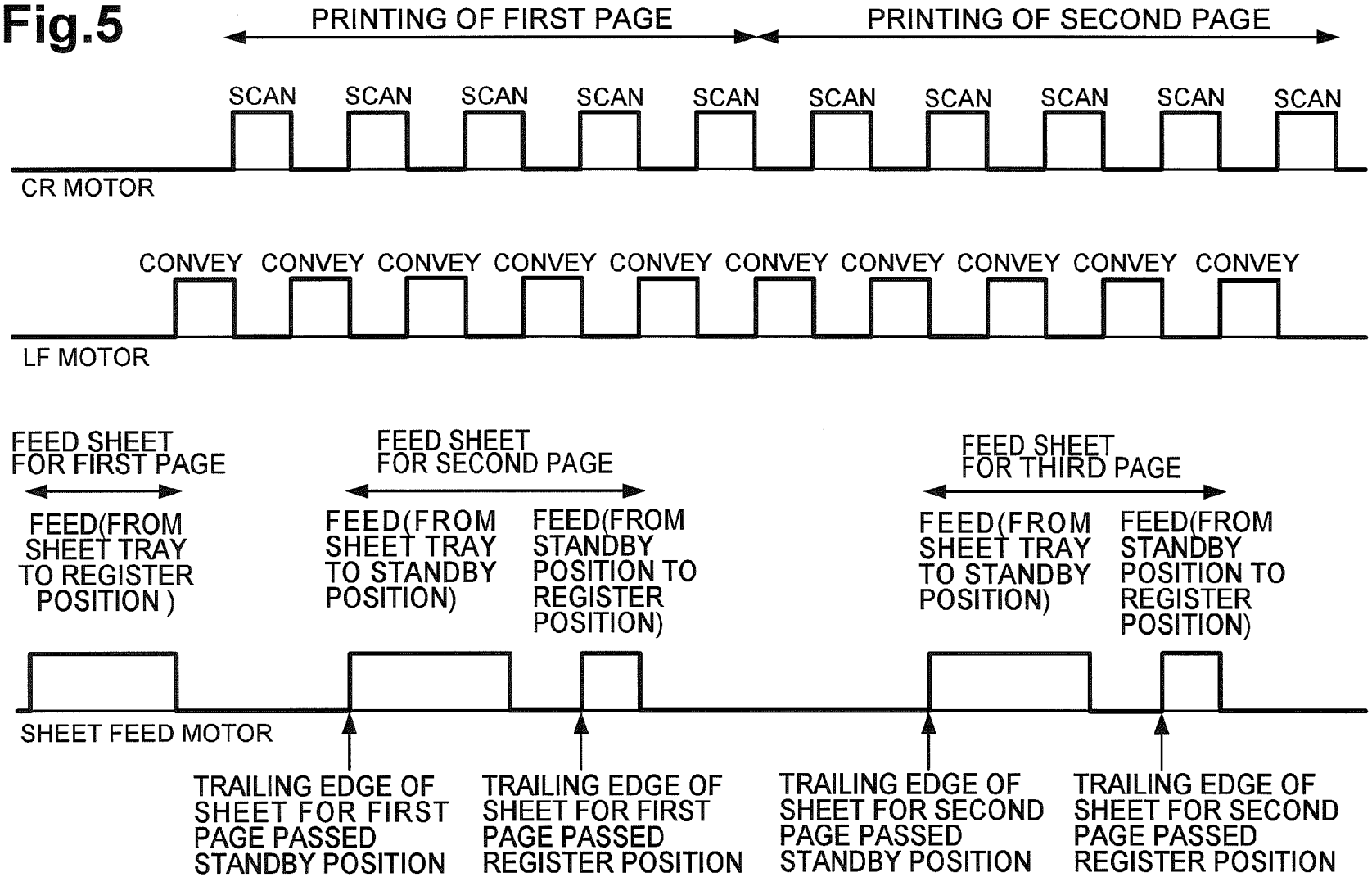
FIG. 5 is a timing chart showing a manner in which a sheet is fed to a conveyor roller and a manner in which a CR motor and an LF motor operate during the sheet conveyance according to an embodiment of the invention
Figure 6:
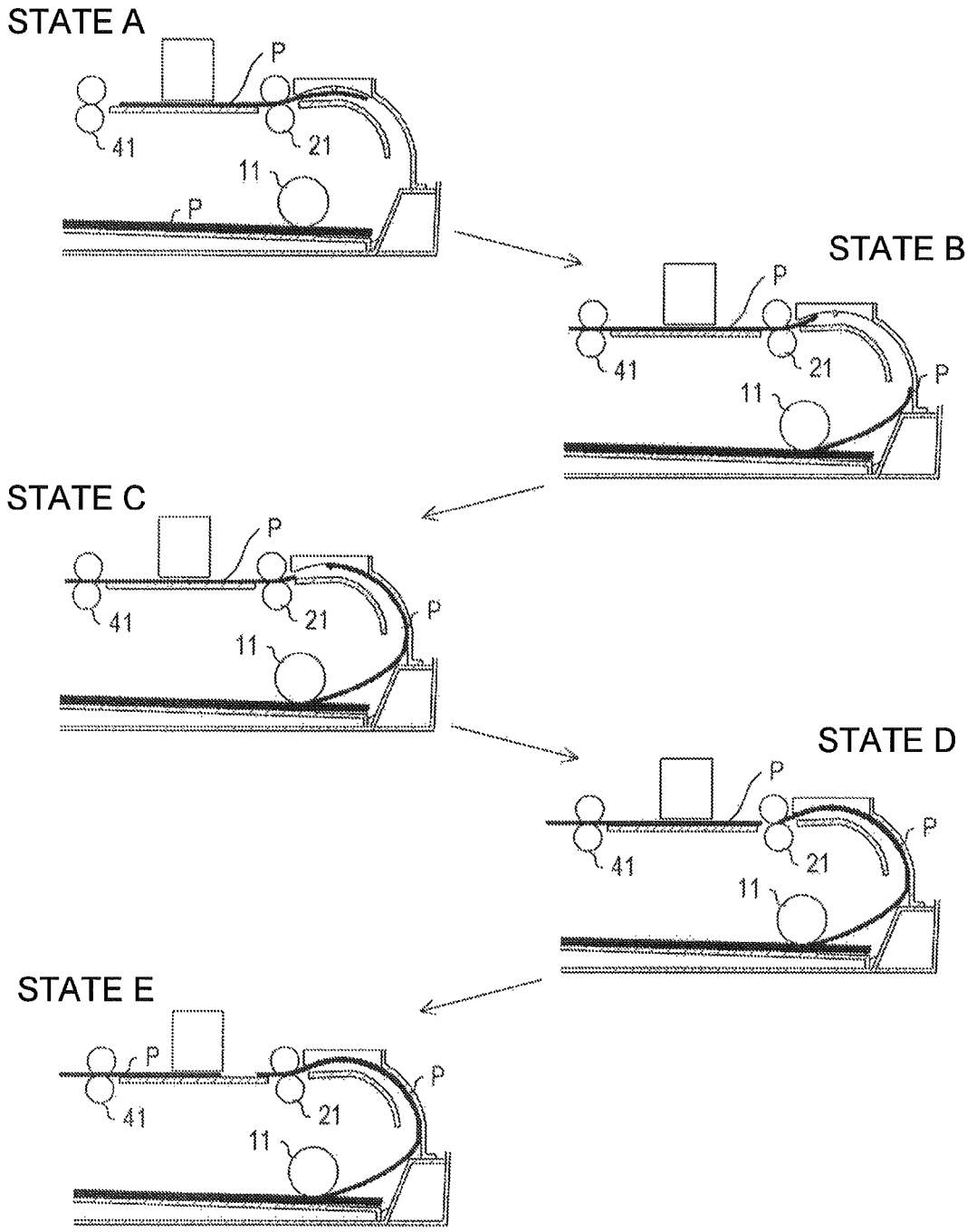
FIG. 6 is a diagram schematically showing a positional relationship between a first sheet and a second sheet.
Figure 7:
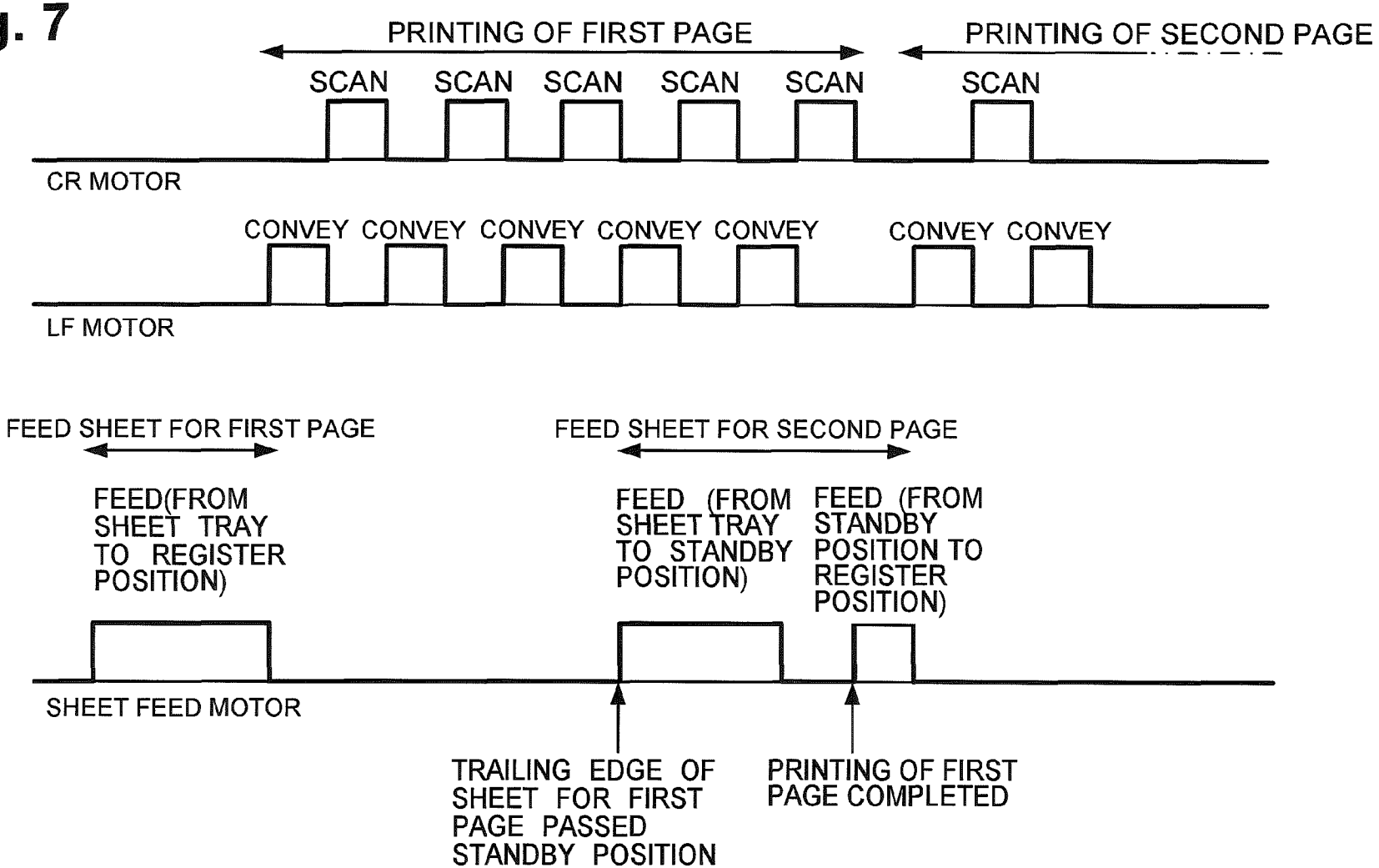
FIG. 7 is a timing chart showing a manner in which a second sheet is fed to the conveyor roller and a manner in which the CR motor and the LF motor operate during the sheet conveyance, according to an embodiment of the invention.

FIGS. 5 to 7 describe a sheet conveyance performed during the print control processing according to an embodiment of the invention. As shown in FIG. 5, when a printing operation for a plurality of continuous pages, e.g., a continuous printing operation, is performed in inkjet printer 1, sheet feed motor 13 first may rotate to feed a sheet P for a first page, e.g., current target sheet P, from sheet tray 3 to the register position. Then, LF motor 23 may rotate to allow conveyor roller 21 to draw current target sheet P for the sheet alignment operation. After that, CR motor 33 may rotate to move carriage 31 in the main scanning direction, which may scan current target sheet P, and one pass printing operation may be performed on current target sheet P.

After one pass printing operation is completed, LF motor 23 may rotate conveyor roller 21 to convey current target sheet P, which currently may be held by conveyor roller 21. Conveyor roller 21 may convey current target sheet P a distance equal to one pass of the recording head. As shown in FIG. 6, inkjet printer 1 repeatedly may perform conveyance of current target sheet P by the predetermined amount and the one pass printing operation on the current target sheet P by alternately driving CR motor 33 and LF motor 23, e.g., as shown in state A of FIG. 6. Hereinafter, operations repeatedly performed by the inkjet printer 1 collectively may refer to a repetitive operation, and these terms may be used interchangeably.

When a trailing edge of the current target sheet P passes standby position Pw, e.g., as shown in a state B of FIG. 6, during the repetitive operation, a sheet P for a second page, e.g., a subsequent target sheet P, may be conveyed from sheet tray 3 and may be fed in an upstream direction in the sheet conveying path. In parallel with the conveyance of subsequent target sheet P, the repetitive operation may be performed on current target sheet P. Once subsequent target sheet P reaches standby position Pw, the conveyance of subsequent target sheet P may end, which may keep subsequent target sheet P at standby position Pw, e.g., as shown in state C of FIG. 6.

When the trailing edge of current target sheet P passes the register position, the subsequent target sheet P may begin to be conveyed from standby position Pw to the register position. Conveyor roller 21 may be prevented from rotating before a subsequent one pass printing operation may be performed on current target sheet P. After the conveyance of subsequent target sheet P begins, the subsequent one pass printing operation may be performed on current target sheet P. As shown in FIG. 5, the conveyance of subsequent target sheet P to the register position may start immediately after conveyor roller 21 stops rotating, and subsequent target sheet P may abut against, e.g., contact, the register position while one pass printing operation may be performed on current target sheet P. By doing so, the skew of subsequent target sheet P may be corrected while conveyor roller 21 stops rotating, e.g., as shown in state D of FIG. 6. As described above, subsequent target sheet P may be fed to conveyor roller 21.

When one pass printing operation on current target sheet P ends while the sheet abutment operation is performed on subsequent target sheet P, conveyor roller 21 may draw subsequent target sheet P in a downstream direction in the sheet conveying path, in parallel with the conveyance of current target sheet P, e.g., as shown in state E of FIG. 6. When all print lines of the data for the first page are printed on current target sheet P, e.g., image printing operation with respect to the sheet P for the first page is completed, a printing operation then may be performed on subsequent target sheet P e.g., the sheet P for the second page, in a similar manner as described above.

If the last print line, e.g., a print end position of the data for the first page is printed at a position which is far from the trailing edge of the current target sheet P e.g., the last print line of the data is shifted to the leading edge side of the current target sheet P, the printing operation, e.g., the repetitive operation, with respect to the sheet P for the first page may end before the trailing edge of current target sheet P passes the register position. In this case, as shown in FIG. 7, after the printing operation with respect to the current target sheet P ends, the subsequent target sheet P, which may be staying at standby position Pw, may be conveyed to the register position, such that subsequent target sheet P may abut against, e.g., contact, the register position for the sheet skew correction, while the conveyor roller 21 may stop rotating. Then, subsequent target sheet P may be drawn toward the recording position by the rotation of LF motor 23.

In an embodiment of the invention, when a subsequent target sheet is supplied to conveyor roller 21 before all print lines of data for a page are printed on a current target sheet, which may have been fed to conveyor roller 21 and may precede the subsequent target sheet, subsequent target sheet may abut against, e.g., contact, the register position and may be fed to conveyor roller 21, while conveyor roller 21 may stop rotating.

Thus, in an embodiment of the invention, subsequent target sheet may be fed to conveyor roller 21, while the skew of the subsequent target sheet may be corrected before the printing operation with respect to the current target sheet is completed. Accordingly, the throughput in the continuous printing operation may be increased while the sheet skew correction is performed, which may increase throughput and print quality.

In an embodiment of the invention, a sheet may be conveyed to standby position Pw, and then the sheet further may be conveyed to conveyor roller 21 from standby position Pw for the sheet abutment operation, while conveyor roller 21 may stop rotating. Thus, the sheet abutment operation may be precisely performed with sufficient time while conveyor roller 21 may not be rotating, The subsequent sheet may be quickly conveyed, while the overlap between the preceding sheet and the subsequent sheet is prevented during the sheet conveyance as described above. Thus, the throughput in the continuous printing operation may be efficiently increased, and image quality deterioration may be reduced.

In an embodiment of the invention, the subsequent target sheet may abut against, e.g., contact, the conveyor roller 21 immediately after the conveyor roller 21 stops rotating. Thus, the sheet skew correction may be performed on the next target sheet by making full use of the period during which the conveyor roller 21 intermittently stops rotating. According to an embodiment of the invention, when the subsequent sheet becomes unnecessary to be used although the feeding of the subsequent target sheet was started in advance, the subsequent sheet may be returned to the sheet tray 3, which may prevent deformation of the subsequent target sheet, and may allow inkjet printer 1 to start the subsequent printing operation with the subsequent target sheet accommodated at an appropriate position.

Figure 8:
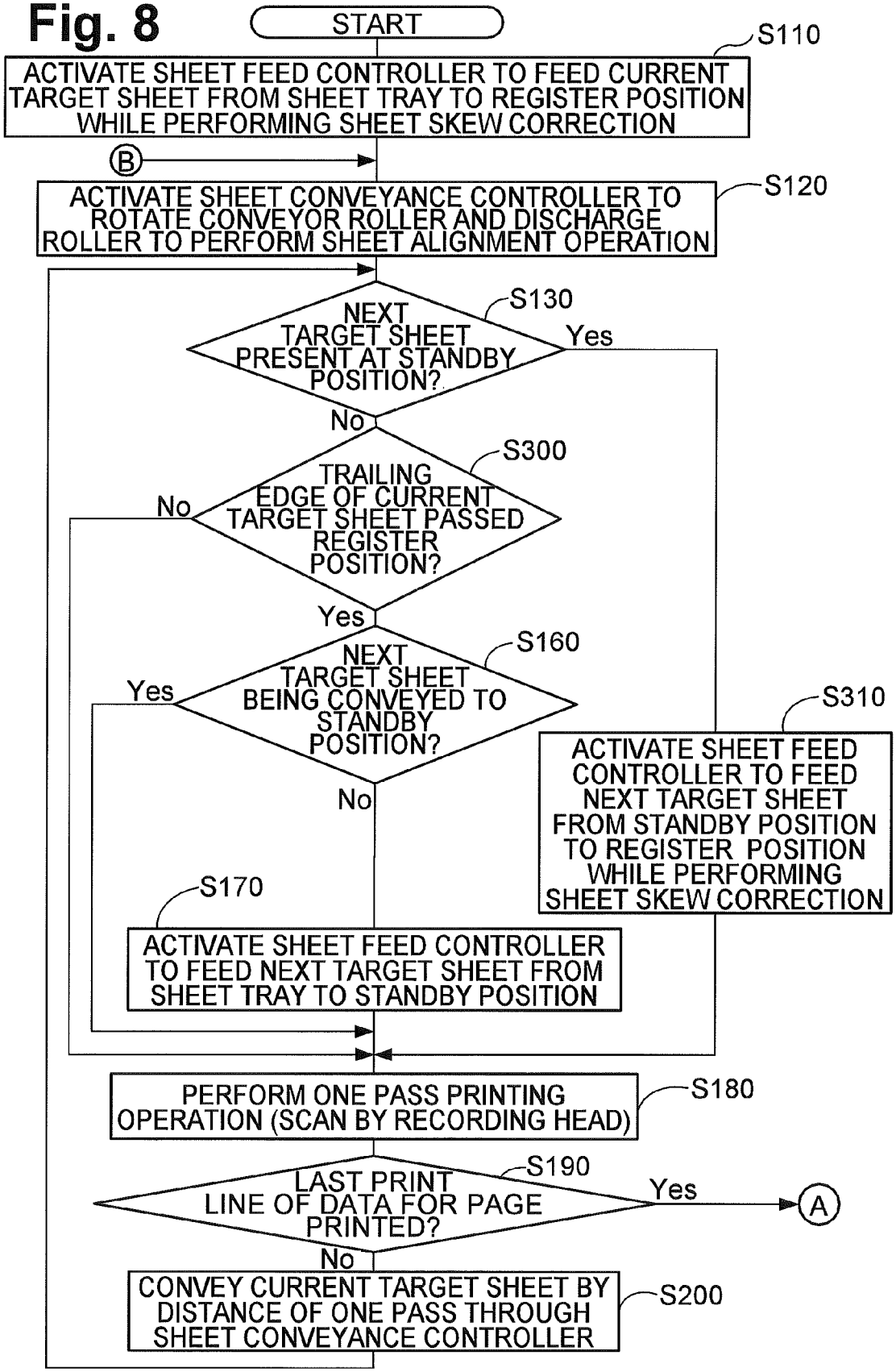
FIG. 8 is a flowchart of print control processing performed by the CPU according to another embodiment of the invention.
Figure 9:
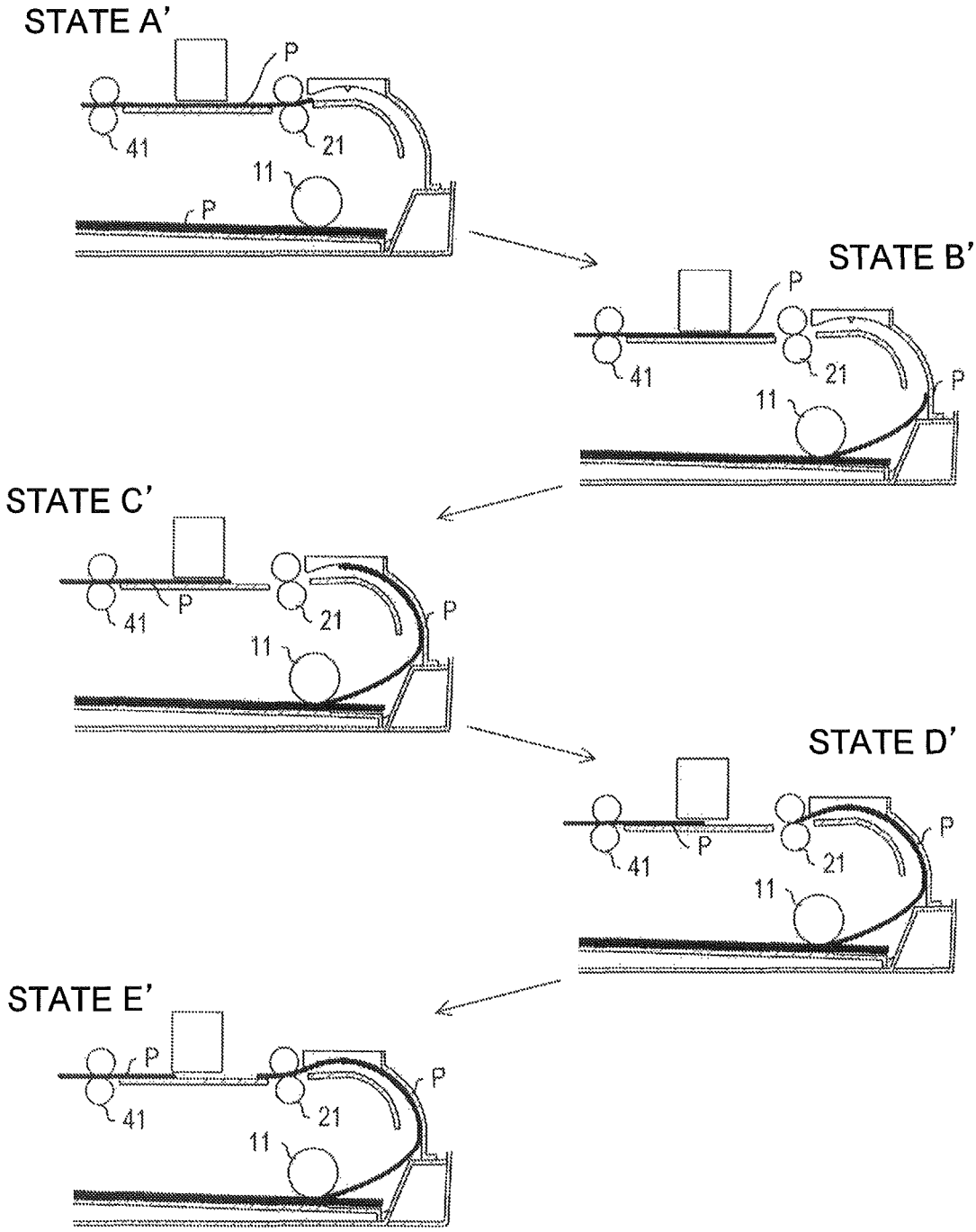
FIG. 9 is a diagram schematically showing a positional relationship between a first sheet and a second sheet according to another embodiment of the invention.

FIGS. 8 and 9 illustrate control processing performed by CPU 71 according to another embodiment of the invention. As shown in FIG. 8, the print control processing according to this embodiment of the invention may include processing of steps that may be similar to those shown in FIGS. 3 and 4. Thus, descriptions for the similar processing of the steps shown in FIG. 8 will be omitted to avoid duplicate descriptions. At S130, CPU 71 may determine whether a subsequent target sheet P, following a current target sheet P, is present at standby position Pw. This determination by CPU 71 may be based on the position information about current target sheet P, which may be obtained by head/motor controller 80. When CPU 71 determines that subsequent target sheet P is present at standby position Pw, e.g., S130:YES, flow may continue to S310. When CPU 71 determines that subsequent target sheet P is not present at standby position Pw, e.g., S130:NO, flow may continue to S300.

At S300, CPU 71 may determine whether a trailing edge of current target sheet P has passed the register position. This determination of CPU 71 may be based on the position information about current target sheet P, which may be obtained from head/motor controller 80. When CPU 71 determines that the trailing edge of current target sheet P has not passed the register position, e.g., S300:NO, flow may continue to S180. At S180, a one pass printing operation may be performed on current target sheet P, while subsequent target sheet P may be prevented from being fed from sheet tray 3, as shown in state A' of FIG. 9.

When CPU 71 determines that the trailing edge of current target sheet P has passed the register position, e.g., S300: YES, flow may continue to S160. If CPU 71 determines that of subsequent target sheet P has not begun to be conveyed from sheet tray, e.g., S160:NO, flow may continue to S170. At S170, CPU 71 may control sheet feed controller 85, such that subsequent target sheet P may be fed to standby position Pw from the sheet tray 3, as shown in state B' of FIG. 9. Subsequently, flow may continue to S180.

When CPU 71 determines that subsequent target sheet P is present at standby position Pw, e.g., S130:YES, as shown in state C' in FIG. 9, flow may continue to S310. At S310, CPU 71 may send a command to head/motor controller 80 to activate sheet feed controller 85, such that subsequent target sheet P, which may stay at standby position Pw, may be conveyed to the register position before a one pass printing operation is performed on current target sheet P at S180. Upon a start of the conveyance of subsequent target sheet P from standby position Pw to the register position, the one pass printing operation may be performed on current target sheet P at S180. While one pass printing operation is performed, CPU 71 may control sheet feed controller 85 such that subsequent target sheet P may abut against, e.g., contact the register position for the sheet skew correction, and may be fed to conveyor roller 21, as shown in state D' of FIG. 9. Then, CPU 71 may rotate conveyor roller 21 to further convey subsequent target sheet P to the recording position, as shown in state E' of FIG. 9.

In still another embodiment of the invention, the feeding of the next target sheet from sheet tray 3 may begin when the trailing edge of the preceding sheet passes the register position, which may avoid overlap between the preceding sheet and the next sheet during the sheet conveyance.

While the invention has been described in connection with preferred embodiments, it will be understood by those skilled in the art that other variations and modifications of the preferred embodiments described above may be made without departing from the scope of the invention. Other embodiments will be apparent to those skilled in the art from a consideration of the specification or practice of the invention disclosed herein. It is intended that the specification and the described examples are considered as exemplary of the claimed invention, the scope of which is indicated by the following claims.

What is claimed is:

1. An image forming apparatus comprising:

a tray configured to accommodate a plurality of sheets;

a sheet conveying path through which the plurality of sheets are conveyed;

a sheet feeding unit comprising a sheet feed roller configured to feed the plurality of sheets one by one from the tray through the sheet conveying path to a sheet holding position, and a sheet feed motor configured to rotate to transfer a drive force to the sheet feed roller;

a sheet conveying unit comprising:

a conveyor roller configured to intermittently hold a first sheet at the sheet holding position and to transport the first sheet intermittently; and a conveyor motor configured to, independently from the sheet feed motor, rotate to transfer a drive force to the conveyor roller, the conveyor roller being disposed upstream from a recording position and downstream from the sheet feed roller with respect to a sheet feed direction, the sheet holding position being positioned upstream from the recording position and downstream from the sheet feed roller with respect to the sheet feed direction;

a recording unit configured to form an image onto a surface of the first sheet stopped at the recording position; and a controller configured to control the sheet feed motor and the conveyor motor such that the conveyor roller does not rotate while the recording unit forms an image onto the first sheet, such that the sheet feed roller continues to rotate to feed a second sheet from the tray through the sheet conveying path to a predetermined position which is positioned upstream of the sheet holding position both when the conveyor roller is rotating to transport the first sheet and when the conveyor roller is not rotating while the recording unit forms an image onto the first sheet, and when the second sheet reaches the predetermined position, the sheet feed roller stops rotating, and such that when the conveyor roller stops rotating while the recording unit forms an image onto the first sheet, the sheet feed roller restarts rotating and keeps rotating to maintain colliding of a leading edge of the second sheet against the conveyor roller, which is not rotating at the sheet holding position, to correct a skew of the second sheet.

2. The image forming apparatus of claim 1, further comprising a sheet discharging unit comprising a discharge roller configured to rotate intermittently in synchronization with the conveyor roller, and disposed downstream from the recording position.

3. The image forming apparatus of claim 2, wherein the sheet discharging unit is configured to hold the first sheet while the recording unit forms an image, and to discharge the sheet to a downstream end of the sheet conveying path by the rotation of the discharge roller.

4. The image forming apparatus according to claim 1, wherein the controller is configured to determine whether a trailing edge of the first sheet, which is conveyed downstream in the sheet conveying path by the conveyor roller, has passed the sheet holding position, and wherein when the trailing edge of the first sheet has passed the sheet holding position, the sheet feeding unit is configured to feed the second sheet from the tray to the sheet holding position, until the second sheet contacts the conveyor roller at the sheet holding position.

5. The image forming apparatus according to claim 1, wherein the sheet feeding unit is configured to feed the second sheet from the tray a predetermined distance which temporarily positions a leading edge of the second sheet at a predetermined standby position upstream from the sheet holding position in the sheet conveying path, and wherein the sheet feeding unit is configured to feed the second sheet to the conveyor roller at a position in which the second sheet contacts the conveyor roller at the sheet holding position, to correct a skew of the second sheet while the conveyor roller is not rotating.

6. The image forming apparatus according to claim 5, wherein the controller is configured to determine whether a trailing edge of the first sheet, which is fed to the conveyor roller, has passed the standby position, and when the trailing edge of the first sheet passes the standby position, the sheet feeding unit is configured to begin feeding the second sheet from the tray.

7. The image forming apparatus according to claim 5, wherein the sheet feeding unit is configured to further convey the second sheet, which is temporarily positioned at the standby position, to the sheet holding position after the conveyor roller and the discharge roller stop rotating.

8. The image forming apparatus according to claim 1, wherein the controller is configured to determine whether to feed the second sheet to the conveyor roller, and the sheet feeding unit is configured to return the second sheet to the tray when the controller determines not to feed the second sheet to the conveyor roller.

9. The image forming apparatus of claim 1, wherein the controller is further configured to control the sheet feed motor and the conveyor motor such that the sheet feed roller rotates without rotating the conveyor roller while the recording unit forms an image onto the first sheet.

10. The image forming apparatus of claim 1, wherein the controller is further configured to control the sheet feed motor and the conveyor motor such that the rotating of the conveyor roller and the forming of an image without rotating the conveyor roller are alternately repeated while the sheet feed roller rotates for feeding the second sheet.

11. A method of feeding a sheet for an image forming apparatus, the image forming apparatus comprising a sheet feeding unit comprising a sheet feed roller and a sheet feed motor configured to rotate to transfer a drive force to the sheet feed roller, a sheet conveying unit comprising a conveyor roller disposed upstream from a recording position and downstream from the sheet feed roller with respect to a sheet feed direction, the sheet holding position being positioned upstream from the recording position and downstream from the sheet feed roller with respect to the sheet feed direction, and a conveyor motor configured to, independently from the sheet feed motor, rotate to transfer a drive force to the conveyor roller, and a recording unit configured to form an image onto a surface of a first sheet at a recording position, the method comprising the steps of (a) controlling the sheet feed motor to feed a plurality of sheets one by one from a tray through a sheet conveying path to a sheet holding position;

(b) controlling the conveyor motor to intermittently hold the first sheet at the sheet holding position and transport the first sheet intermittently; and (c) controlling the sheet feed motor and the conveyor motor such that the conveyor roller does not rotate while the recording unit forms an image onto the first sheet, such that the sheet feed roller continues to rotate to feed a second sheet from the tray through the sheet conveying path to a predetermined position which is positioned upstream of the sheet holding position both when the conveyor roller is rotating to transport the first sheet and when the conveyor roller is not rotating while the recording unit forms an image onto the first sheet, and when the second sheet reaches the predetermined position, the sheet feed roller stops rotating and such that when the conveyor roller stops rotating while the recording unit forms an image onto the first sheet, the sheet feed roller restarts rotating and keeps rotating to maintain colliding of a leading edge of the second sheet against the conveyor roller, which is not rotating at the sheet holding position, to correct a skew of the second sheet.

12. The method of feeding a sheet according to claim 11, further comprising the steps of:

determining whether a trailing edge of the first sheet, which is conveyed toward the downstream in the sheet conveying path by the controlling step (a), has passed the sheet holding position; and feeding the second sheet from the tray to the sheet holding position when the trailing edge of the first sheet has passed the sheet holding position, until the second sheet contacts a conveyor roller at the sheet holding position.

13. The method of feeding a sheet according to claim 11, further comprising the steps of:

feeding the second sheet from the tray a predetermined distance which temporarily positions a leading edge of the second sheet at a predetermined standby position upstream from the sheet holding position in the sheet conveying path; and feeding the second sheet to the conveyor roller at a position in which the second sheet contacts the conveyor roller at the sheet holding position, to correct the skew of the second sheet while the conveyor roller is not rotating.

14. The method of feeding a sheet according to claim 13, further comprising the steps of:

determining whether a trailing edge of the first sheet, which is fed to the conveyor roller, has passed the standby position; and beginning to feed the second sheet from the tray when the determining step determines that the trailing edge of the first sheet has passed the standby position.

15. The method of feeding a sheet according to claim 13, further comprising the step of further conveying the second sheet, which is temporarily positioned at the standby position, to the sheet holding position immediately after the conveyor roller and a discharge roller stop rotating.

16. The method of feeding a sheet according to claim 11, further comprising the steps of:

determining whether to feed the second sheet to the conveyor roller; and returning the second sheet to the tray when the determining step determines not to feed the second sheet to the conveyor roller.

17. The method of feeding a sheet according to claim 11, wherein the controlling step (c) comprises controlling the sheet feed motor and the conveyor motor such that the sheet feed roller rotates without rotating the conveyor roller while the recording unit forms an image onto the first sheet.

18. The method of feeding a sheet according to claim 11, wherein the controlling step (c) comprises controlling the sheet feed motor and the conveyor motor such that the rotating of the conveyor roller and the forming an image without rotating the conveyor roller are alternately repeated while the sheet feed roller rotates for feeding the second sheet.

* * * * *